US006550290B2

(12) United States Patent
Shimakage et al.

(10) Patent No.: US 6,550,290 B2
(45) Date of Patent: Apr. 22, 2003

(54) DRUM TYPE WASHING MACHINE WITH LAUNDRY WEIGHT DETECTING MEANS

(75) Inventors: Katsuyuki Shimakage, Owariasahi (JP); Kiyoe Ochiai, Nagoya (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 09/982,087

(22) Filed: Oct. 19, 2001

(65) Prior Publication Data

US 2002/0046581 A1 Apr. 25, 2002

(30) Foreign Application Priority Data

Oct. 24, 2000 (JP) ..... 2000-323973

(51) Int. Cl.[7] ..... D06F 33/02

(52) U.S. Cl. ..... 68/12.04; 68/12.06; 68/12.18; 68/12.27

(58) Field of Search ..... 68/12.04, 12.06, 68/12.18, 12.27

(56) References Cited

U.S. PATENT DOCUMENTS 5,161,393 A * 11/1992 Payne et al. ..... 68/12.04
5,230,228 A * 7/1993 Nakano et al. ..... 68/12.04
5,325,677 A * 7/1994 Payne et al. ..... 68/12.04
5,507,054 A * 4/1996 Blauert et al. ..... 68/12.04 X

* cited by examiner

*Primary Examiner*—Philip R. Coe
(74) *Attorney, Agent, or Firm*—Pillsbury Winthrop LLP

(57) ABSTRACT

A drum type washing machine includes a drum for accommodating laundry and a variable speed electric motor for rotating the drum. A rise time is detected when the drum or the motor is accelerated from a first predetermined rotational speed to a second predetermined rotational speed while a predetermined constant power is being supplied to the motor. A fall time is detected when the drum or the motor is decelerated from a third predetermined rotational speed to a fourth predetermined rotational speed while the motor is in a free running state. A weight of the laundry in the drum is detected on the basis of the detected rise and fall times. A balance of the laundry in the drum is detected. The detected weight is compensated according to a result of balance detection.

9 Claims, 13 Drawing Sheets

| RESULT OF WEIGHT DETECTION | DISPLAY OF DETERGENT AMOUNT |
|---|---|
| VERY SMALL 0 TO 1 KG | 0.4 CUPS |
| SMALL 1 TO 2 KG | 0.6 CUPS |
| INTERMEDIATE 2 TO 4 KG | 0.8 CUPS |
| LARGE AT OR ABOVE 4 KG | 1.0 CUPS |

FIG. 7

WHERE D=1.9 SEC, E=2.1 SEC AND F=2.4 SEC.

| ROTATIONAL VARIATION | | COMPENSATING FACTOR k |
|---|---|---|
| A | 300H ~ 400H | 0.98 |
| B | 400H ~ 500H | 0.95 |
| C | 500H ~ | 0.9 |

FIG. 14

DRUM TYPE WASHING MACHINE WITH LAUNDRY WEIGHT DETECTING MEANS

BACKGROUND OF THE INVENTION

1. Field of the Invention

This invention relates to a drum type washing machine provided with means for detecting the weight of laundry accommodated in a drum.

2. Description of the Related Art

Conventional drum type washing machines comprise an outer cabinet, a water tub provided in the outer cabinet, a drum provided in the water tub so as to be rotated about a horizontal axis by an electric motor. In a conventional method of detecting the weight of laundry accommodated in the drum, displacement detecting means is provided for detecting an amount of displacement of the water tub vertically displacing according to the weight of laundry. The weight of the laundry is detected on the basis of the amount of displacement detected by the displacement detecting means. Further, another method has been suggested. In this method, rotational speed detecting means is provided for detecting a rotational speed of the motor or drum. When a rotational speed of the motor or drum is increased from zero to a predetermined value or decreased from a predetermined speed, a change in the rotational speed is detected. The weight of the laundry is detected on the basis of the change in the rotational speed of the motor or drum.

However, the cost of the washing machine is increased. In the latter method, the laundry weight detection takes a long time when the speed change is detected by driving the motor or drum at a high speed. On the other hand, when the speed change is detected by driving the motor or drum at a low speed, whether the laundry is one-sided in the drum, that is, a degree in the balance of the laundry adversely affect the change in the rotational speed of the motor or drum. As a result, the accuracy in the weight detection is reduced.

SUMMARY OF THE INVENTION

Therefore, an object of the present invention is to provide a drum type washing machine in which the detection of laundry weight can be carried out at a low cost with high accuracy.

The present invention provides a drum type washing machine comprising a drum for accommodating laundry and a variable speed electric motor for rotating the drum. Rotational speed detecting means is provided for detecting a rotational speed of the drum or the motor. Rise time detecting means is provided for detecting a rise time in a case where the drum or the motor is accelerated from a first predetermined rotational speed to a second predetermined rotational speed while a predetermined constant power is being supplied to the motor. Fall time detecting means is provided for detecting a fall time in a case where the drum or the motor is decelerated from a third predetermined rotational speed to a fourth predetermined rotational speed while the motor is in a free running state. Weight detecting means is provided for detecting a weight of the laundry in the drum on the basis of results of detection by the rise and fall time detecting means. Balance detecting means is provided for detecting a balance of the laundry in the drum. In the drum type washing machine, the weight detecting means compensates a result of detection according to a result of detection by the balance detecting means.

In the foregoing washing machine, the weight of the laundry in the drum is detected on the basis of the rise time and the fall time. This detecting manner can be realized by a lower cost than the detection of the displacement amount of the water tub. Moreover, the detecting accuracy can be rendered higher in the foregoing arrangement than in the case where the weight of the laundry is detected on the basis of either rise time or fall time. Further, the weight detecting means compensates the result of detection thereof according to the result of detection by the balance detecting means. Thus, since an error due to the balance of the laundry is added to the compensation, the detecting accuracy can further be improved. Additionally, a high accuracy is achieved even when the rise and fall times are detected on the basis of a low rotational speed of the motor or drum. Consequently, a detecting time can be reduced.

The drum type washing machine preferably further comprises control means for displaying an amount of a detergent to be used on the basis of the result of detection by the weight detecting means. Further, the balance detecting means preferably determines the balance on the basis of a ratio of the rise time and the fall time. Additionally, the drum type washing machine preferably further comprises rotational speed variation detecting means for detecting a rotational speed variation of the drum or the motor before the rise time is detected. In this arrangement, the weight detecting means compensates the result of detection on the basis of a result of detection by the rotational speed variation detecting means and the result of detection by the balance detecting means.

SUMMARY OF THE INVENTION

Other objects, features and advantages of the present invention will become clear upon reviewing the following description of embodiments, made with reference to the accompanying drawings, in which:

FIG. 7 shows the relationship between a result of detection of laundry weight and an amount of detergent;

FIG. 14 shows the relationship between a varying state of rotation and a compensation factor.

DETAILED DESCRIPTION OF EMBODIMENTS

Figure 1:
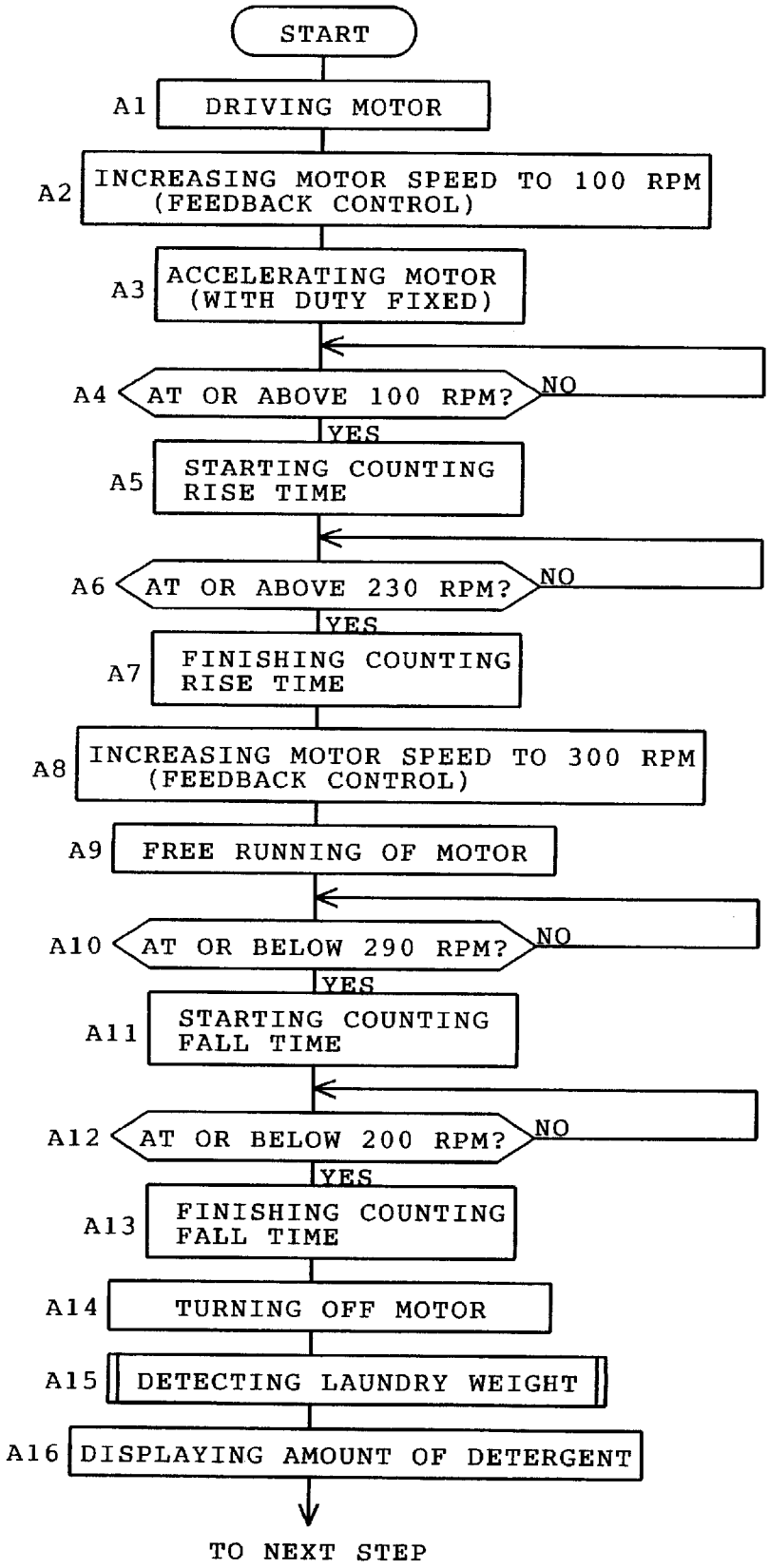
FIG. 1 is a flowchart showing an operation from detection of laundry weight to display of an amount of detergent in a drum type washing machine of a first embodiment in accordance with the present invention.
Figure 2:
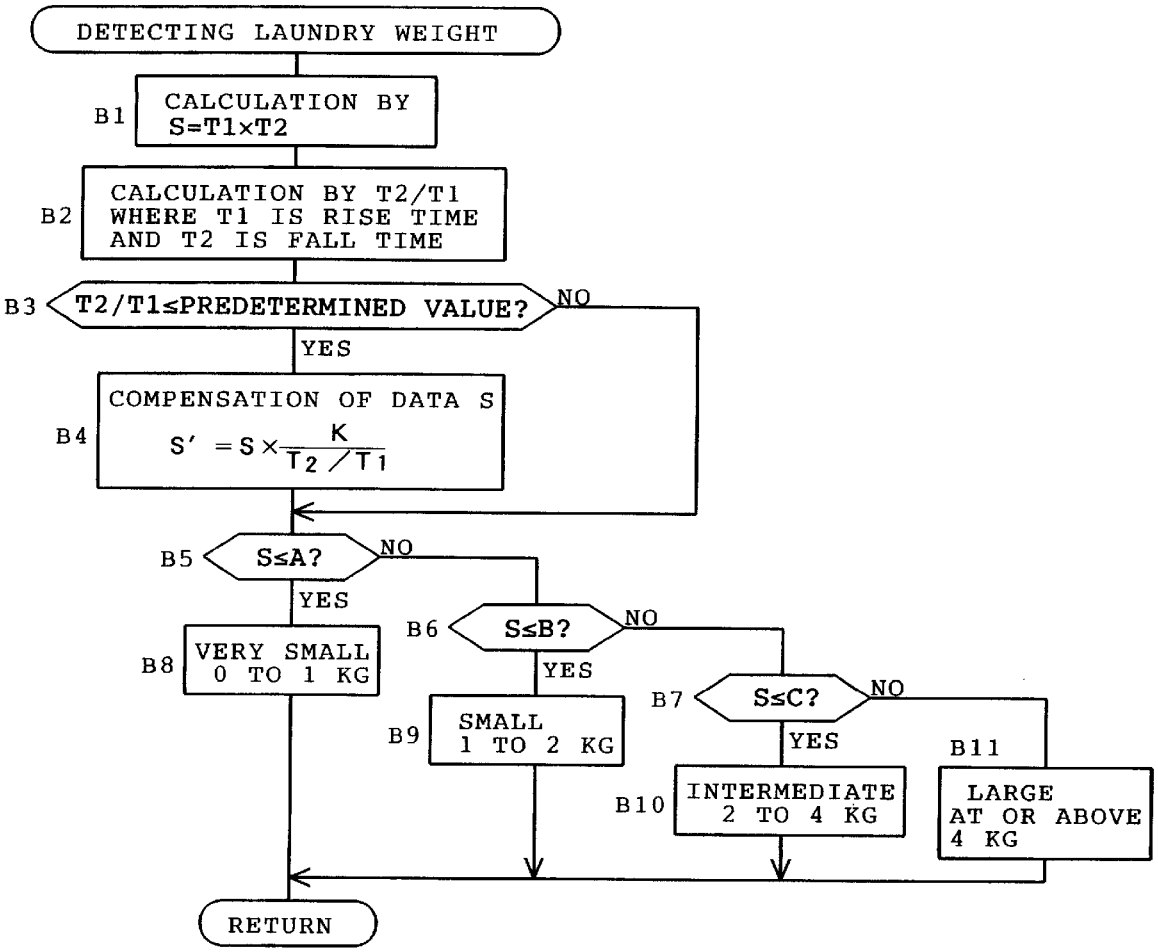
FIG. 2 is a flowchart showing a weight detecting routine.
Figure 3:
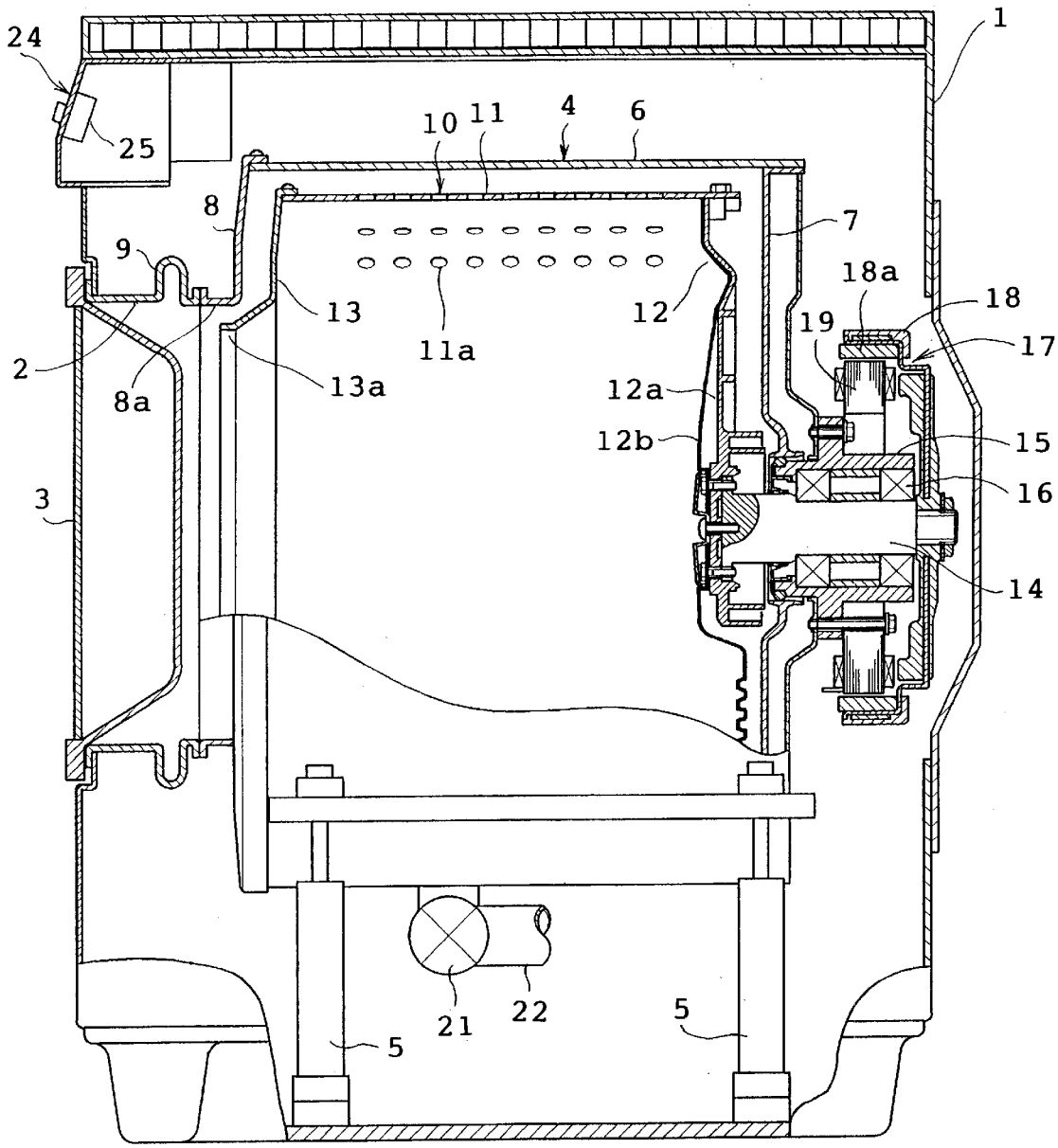
FIG. 3 is a longitudinally side section of the drum type washing machine.

A first embodiment of the present invention will be described with reference to FIGS. 1 to 7. Referring first to FIG. 3, a drum type washing machine of the first embodiment is shown. The shown drum type washing machine comprises an outer cabinet 1 formed into the shape of a generally rectangular box. The outer cabinet 1 includes a front having a centrally formed access opening 2 through which laundry is put into and taken out of a drum 10. The access opening 2 is closed and opened by a lid 3. A generally circularly cylindrical water tub 4 with a horizontal axis is elastically supported on suspension mechanisms 5 in the outer cabinet 1.

The water tub 4 includes a body 6, a rear panel 7 and a front panel 8 each of which is made a metal. The front panel 8 is formed with a circular opening 8*a* connected to the access opening 2 by a cylindrical connecting member 9 made of an elastic material such as rubber so as to communicate with the opening 2. The drum 10 for accommodating laundry is rotatably mounted in the water tub 4. The drum 10 includes a body 11, a rear panel 12 and a front panel 13 the latter two of which are connected to the body. The body 11 includes a circumferential wall formed with a number of holes 11*a*. The front panel 13 has a circular opening 13*a*. The rear panel 12 includes a frame 12*a* having a plurality of vent holes and a porous panel 12*b* mounted to the frame 12*a*.

A drum shaft 14 is mounted in a central portion of the rear panel 12 of the drum 10 so as to project rearward. The drum shaft 14 is rotatably mounted on bearings 16 housed in a cast bearing housing 15 which is mounted on the rear panel 7 of the water tub 4 so as to extend through a hole (not shown) of the panel 7. As a result, the drum 10 is rotatable. The drum 10 is direct rotated by an electric motor 17 comprising a brushless DC motor of the outer rotor type. In this case, the drum shaft 14 of the drum 10 constitutes a rotational shaft of the motor 17. The motor 17 includes a rotor 18 which is mounted on a rear end of the drum shaft 14 so as to be rotated with the shaft 14. The rotor 18 includes a permanent magnet 18*a*. The motor 17 further includes a stator 19 further including a stator core and coils. The stator 19 is disposed inside the rotor 18. Accordingly, upon rotation of the rotor 18, the drum shaft 14 and accordingly the drum 10 are direct rotated.

Figure 4:
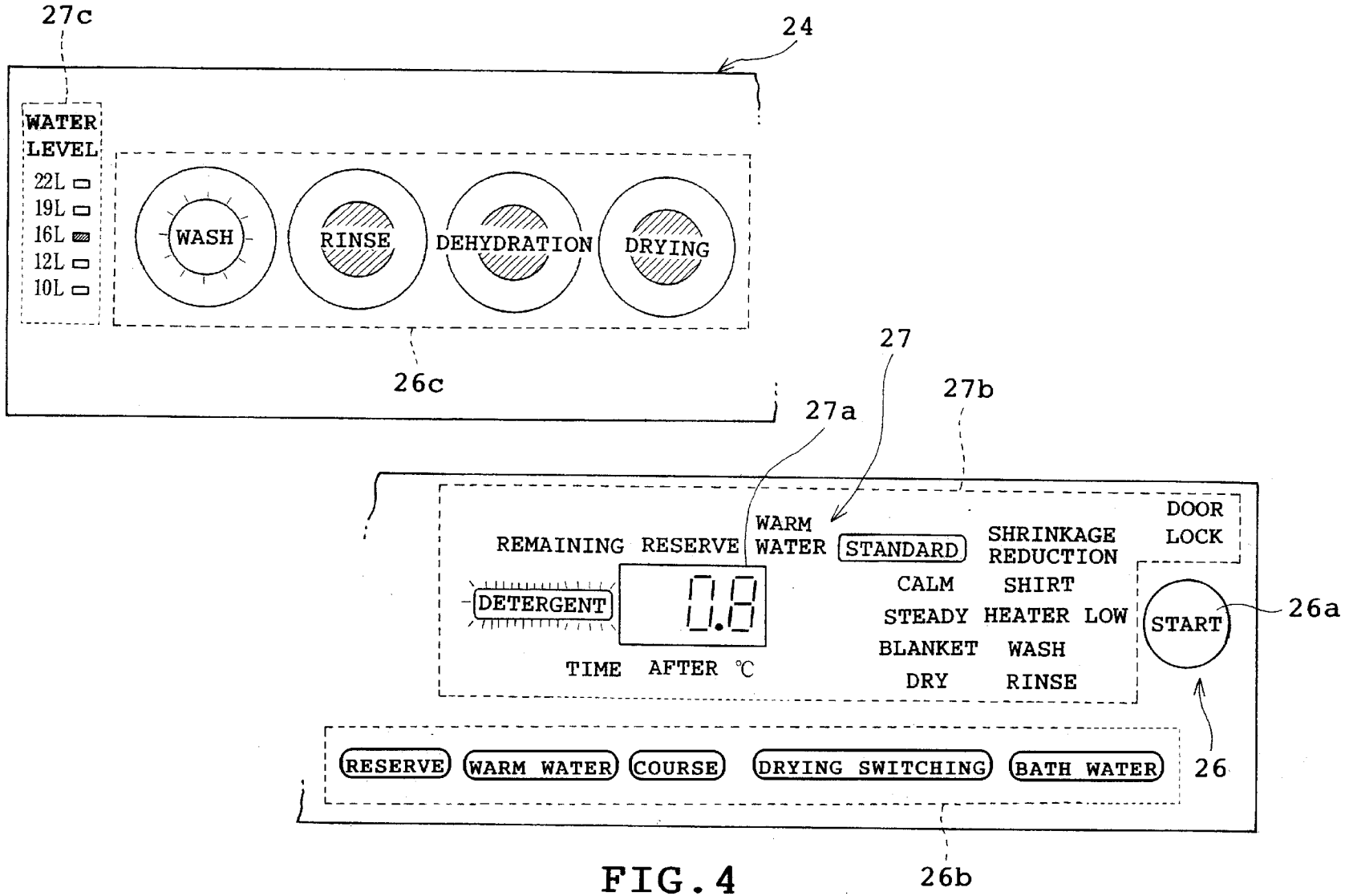
FIG. 4 is a front view of an operation panel of the washing machine.

A drain valve 21 and a drain hose 22 are provided on a lower portion of the circumferential body 6 of the water tub 4. The drain valve 21 is opened and closed by a drain valve motor 20 (see FIG. 5). When the drain valve 21 is opened, water or wash liquid is discharged through the drain hose 22 out of the water tub 4. A water supply valve 23 (see FIG. 5) is provided in an upper portion of the outer cabinet 1 for supplying water into the water tub 4. An electronic unit 25 provided with an operation panel 24 mounted on a front of the panel as shown in FIG. 4 is provided on the upper front of the outer cabinet 1. The operation panel 24 includes operation switches 26 and a display section 27. The operation switches 26 include a start button 26*a*, a washing condition setting switch 26*b* for setting a washing condition, a step setting switch 26*c* including four step setting switches setting wash, rinse, dehydration and drying steps respectively. The display section 27 includes a display panel 27*a* displaying information about washing such as an amount of detergent to be used and a washing time, a washing condition display section 27*b* displaying the set washing condition, and a water amount display section 27*c* displaying an amount of water used in a wash step.

Figure 5:
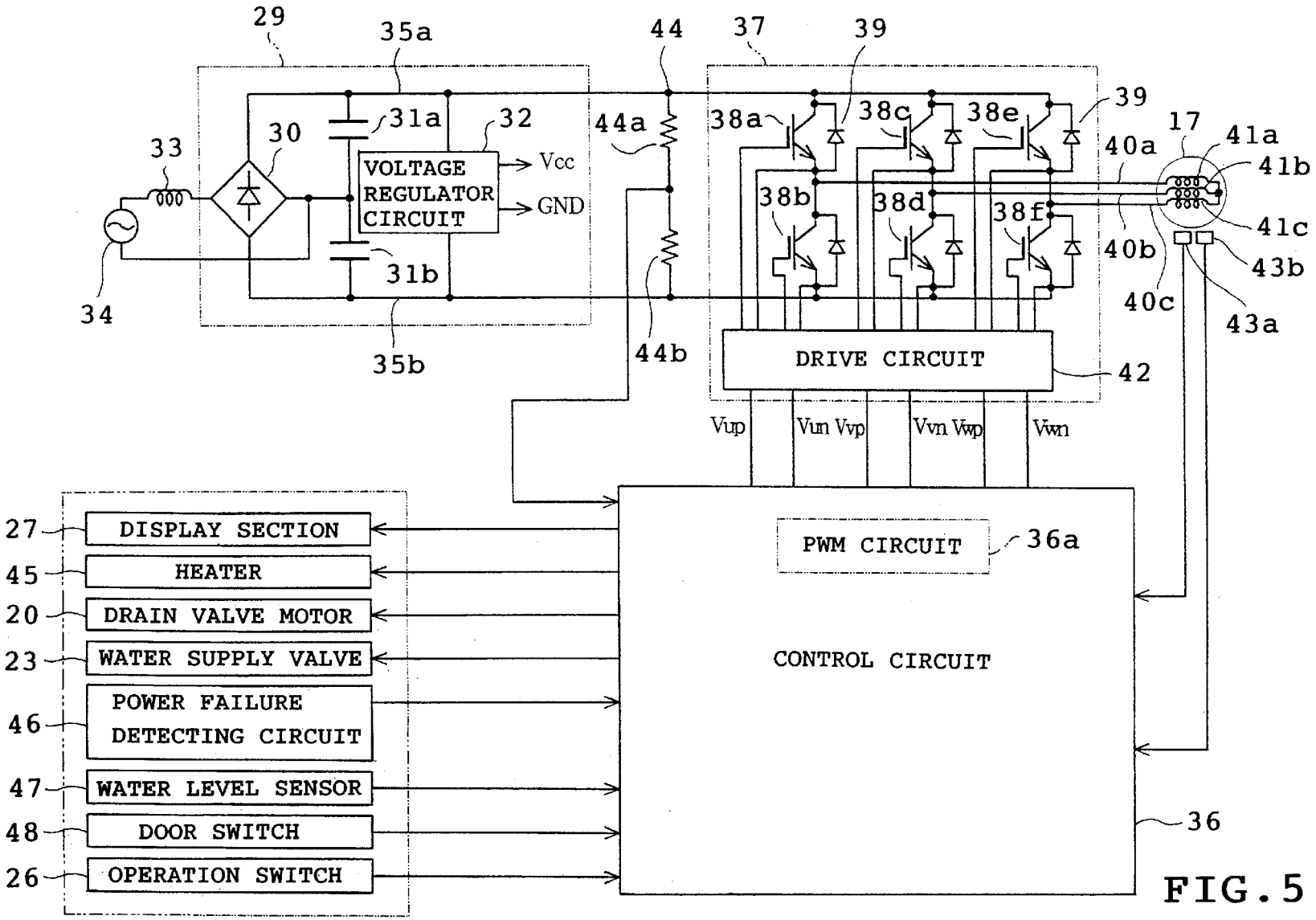
FIG. 5 is a block diagram showing an electrical arrangement of the washing machine.
Figure 6:
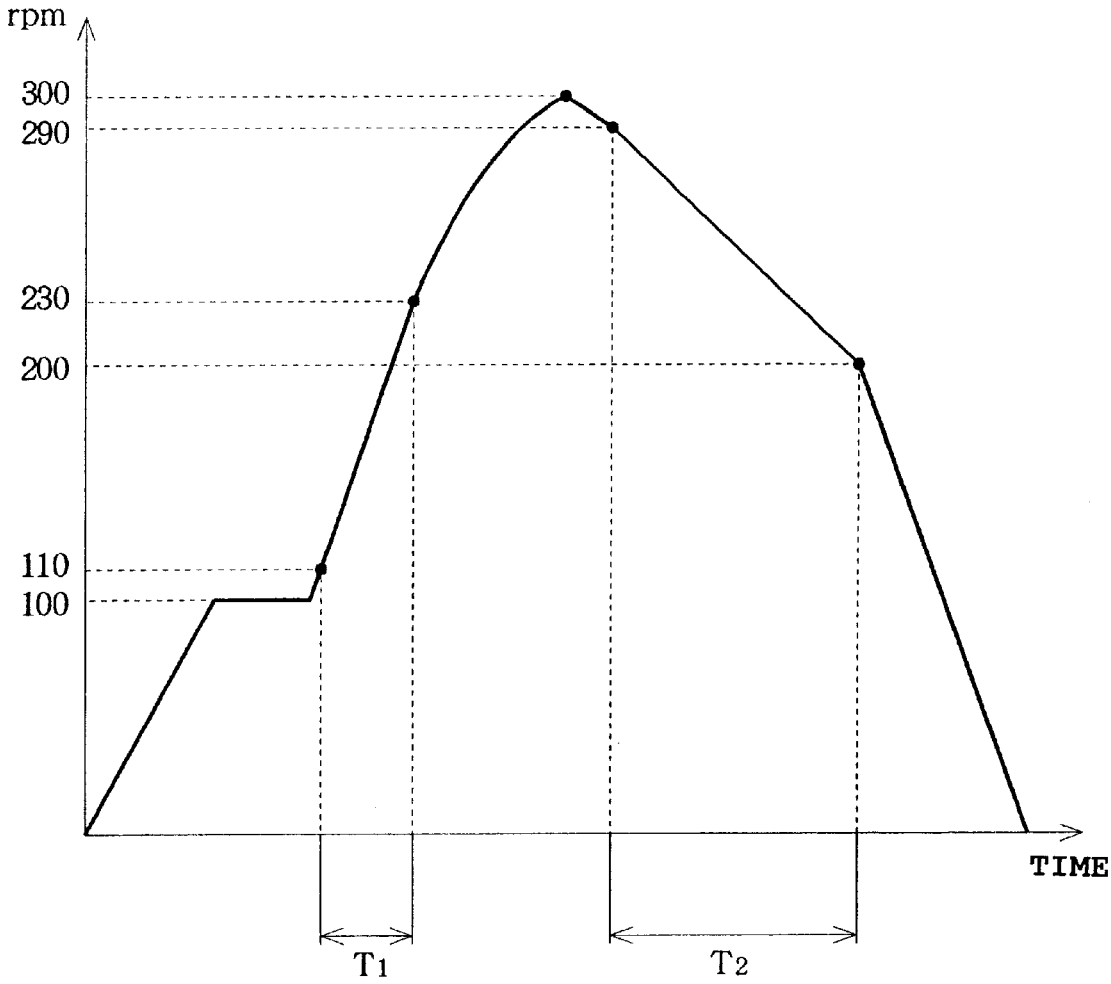
FIG. 6 is a graph showing the relationship between a rotational speed of the motor and time in the detection of laundry weight.
Figure 8:
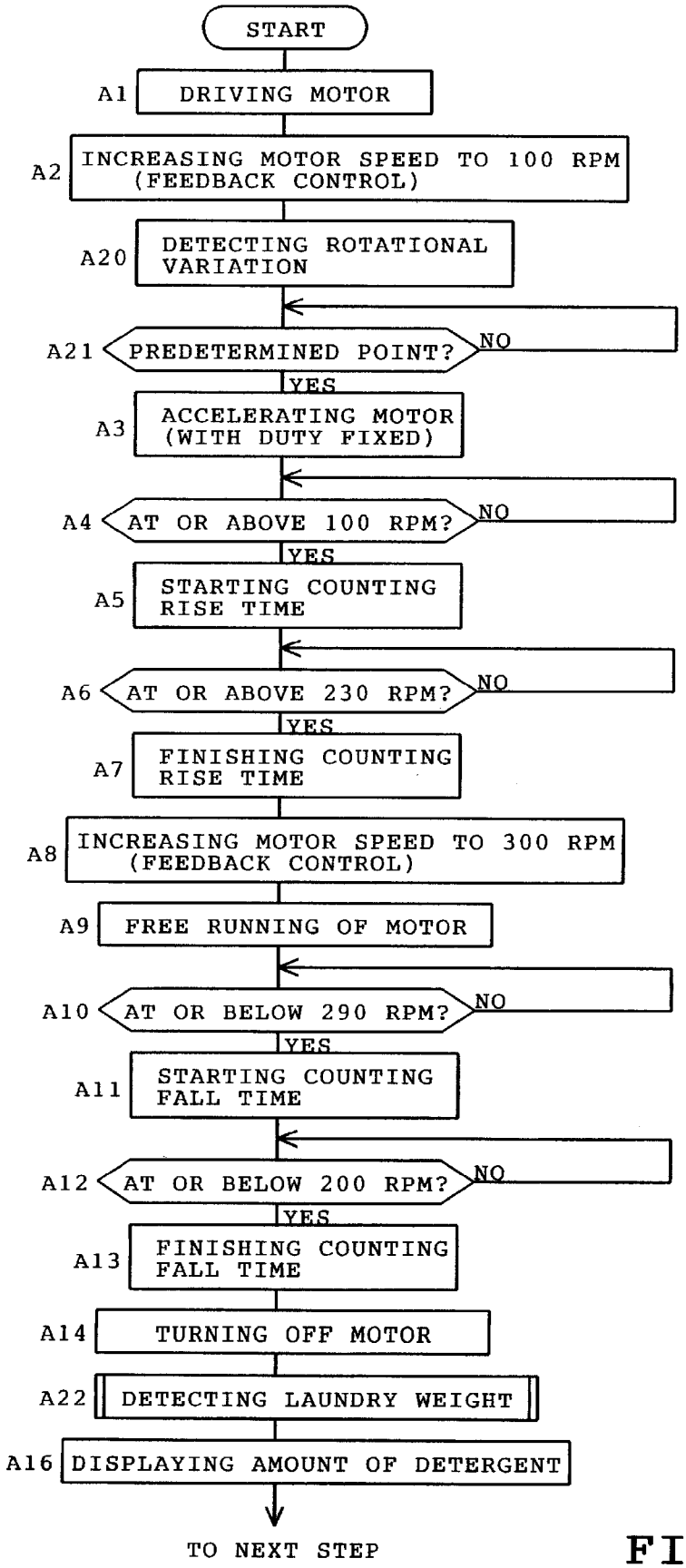
FIG. 8 is a flowchart showing an operation from detection of laundry weight to display of an amount of detergent in a drum type washing machine of a second embodiment in accordance with the present invention.

An electrical arrangement of the drum type washing machine will now be described with reference to FIG. 5. A DC power supply circuit 29 includes a voltage doubler circuit further including a rectifier circuit 30 and smoothing capacitors 31*a* and 31*b*, and a voltage regulator circuit 32. The rectifier circuit 30 has an input terminal to which an AC power supply 34 connected in series to a reactor 33 is further connected. The rectifier circuit 30 has two output terminals to which two DC power supply lines 35*a* and 35*b* are connected respectively. A series circuit of the smoothing capacitors 31*a* and 31*b* is connected between the DC power supply lines 35*a* and 35*b*. A common node of the smoothing capacitors 31*a* and 31*b* is connected to one of the input terminals of the rectifier circuit 30. The voltage regulator circuit 32 is connected between the output terminals of the rectifier circuit 30 to deliver a predetermined DC voltage to each of controlling circuits such as a control circuit 36. An inverter main circuit 37 is connected between the DC power supply lines 35*a* and 35*b*. The inverter main circuit 37 comprises six IGBTs 38*a* to 38*f* connected into a three-phase bridge configuration and free-wheel diodes 39 connected in parallel to IGBTs 38*a* to 38*f* respectively. The inverter main circuit 37 has three output terminals 40*a* to 40*c* connected to terminals of three-phase coils 41*a* to 41*c* of the stator 19 of the motor 17 respectively.

The IGBTs 38*a* to 38*f* have gates connected via photocouplers to a drive circuit 42 delivering drive signals, respectively. The drive circuit 42 is connected to a PWM circuit 36*a* of the control circuit 36 so as to be supplied with a PWM signal from the PWM circuit 36*a*. The control circuit 36 mainly comprises a microcomputer, a ROM and a RAM. Two rotation sensors 43*a* and 43*b* are provided as position detecting elements for detecting a rotational position of the rotor 18. Each rotation sensor comprises a Hall IC. The rotation sensors 43*a* and 43*b* are connected so that signals generated by the rotation sensors 43*a* and 43*b* are delivered to the control circuit 36. The aforesaid motor 17 comprises 24-pole brushless DC motor, and one revolution by the electrical angle corresponds to a 1/12 revolution by the mechanical angle in the motor. In the aforesaid arrangement, the rotation sensors 43*a* and 43*b* and control circuit 36 constitute rotational speed detecting means, rise time detecting means, and fall time detecting means, as will be described in detail later. The control circuit 36 further constitutes weight detecting means, balance detecting means and control means as will be described later.

A voltage divider circuit 44 is connected between the DC power supply lines 35*a* and 35*b* for monitoring a line voltage. The voltage divider circuit 44 comprises two serially connected resistors 44*a* and 44*b* having a common node serving as an output terminal connected to the control circuit 36. The control circuit 36 is further connected to the operation switches 26, display sections 27, drain valve motor 20 and water supply valve 23. The control circuit 36 is additionally connected to a heater 45 for producing hot air, power failure detecting circuit 46, water level sensor 47 and lid switch 48.

The operation of the drum type washing machine will be described with reference to FIGS. 1, 2, 6 and 7. When putting laundry into the drum 10 and closing the door 3, the user depresses the washing condition setting button 26*b* of the operation panel 24 to set a STANDARD course, for example, and further depresses the start button 26*a*. The control circuit 36 then carries out a washing operation according to the flowchart of FIG. 1. The control circuit 36 first starts the motor 17 (step A1) so that the drum 10 is rotated. The control circuit 36 controls the motor 17 in a feedback manner so that the rotational speed of the drum 10 rises to such a rotational speed that the laundry in the drum is forced against the circumferential wall of the drum by a centrifugal force, for example, 100 rpm (step A2). In this case, the rotational speed of the motor 17 is the same as that of the drum 10, and the rotational speed of the motor 17 is detected on the basis of signals delivered by the rotation sensors 43*a* and 43*b*. At step A2, the electric power supplied to the motor 17 is adjusted by the feedback control or a duty ratio is varied so that a target speed (100 rpm) is reached.

The duty ratio is then fixed at a constant value (the value at which the motor speed is increased to a value for detection of a rise time as will be described later) so that the power supplied to the motor 17 becomes constant, so that the motor 17 is accelerated (step A3). The control circuit 36 then determines whether the motor speed has exceeded a first predetermined speed, for example, 110 rpm (step A4). When determining that the motor speed has exceeded the first predetermined speed, the control circuit 36 starts counting the rise time (step A5). The control circuit 36 further determines whether the motor speed has exceeded a second predetermined speed, for example, 230 rpm (step A6). When determining that the motor speed has exceeded the second predetermined speed, the control circuit 36 finishes counting the rise time, storing data of a rise time T1 (step A7). See FIG. 6 as for rise time T1. The second predetermined speed (230 rpm) is set to be lower than a resonance speed of the product, for example, 250 rpm. Furthermore, the aforesaid rise time T1 becomes longer when the weight of the laundry in the drum 10 is large and it becomes shorter when the laundry weight is small.

The control for the motor 17 is then switched to the feedback control manner, and the motor 17 is controlled by the feedback control manner so that the rotational speed of the motor rises to, for example, 300 rpm which is higher than the resonance speed of 250 rpm (step A8). When the speed of the motor 17 has reached 300 rpm, the motor is deenergized such that the motor is in a free running state (step A9). Thereafter, the control circuit 36 detects a fall time. First, the control circuit 36 determines whether the motor speed has been reduced to or below a third predetermined speed, for example, 290 rpm (step A10). When determining that the motor speed has been reduced to or below the third predetermined speed, the control circuit 36 starts counting a fall time (step A11). The control circuit 36 then determines whether the motor speed has been reduced to or below a fourth predetermined speed, for example, 200 rpm (step A12). When determining that the motor speed has been reduced to or below 200 rpm, the control circuit 36 finishes counting the fall time, storing data of a fall time T2 (step A13). See FIG. 6 as for fall time T2. The second predetermined speed (230 rpm) is set to be lower than a resonance speed of the product, for example, 250 rpm. The aforesaid fall time T2 becomes longer when the weight of the laundry in the drum 10 is large and it becomes shorter when the laundry weight is small.

The motor 17 is then turned off (step A14) and the weight detection is carried out (step A15). FIG. 2 shows a weight detection routine. At step B1, determination data S is obtained from the following equation (1), using the rise time T1 detected at step A7 and the fall time T2 detected at step A13:

$$S=T1\times T2 \quad (1)$$

The weight detection is preferably executed in consideration of both rise time T1 and fall time T2. The reason for this is that a balance of the laundry in the drum 10 is not always constant, and the rise and fall times T1 and T2 vary depending upon the balance of the laundry even when the weight of the laundry is the same. When the laundry is ill balanced, the rise time T1 becomes longer, whereas the fall time T2 becomes shorter. Thus, since the rise and fall times T1 and T2 oppose to each other, it is preferable to determine the weight of the laundry on the basis of the data S including both rise time T1 and fall time T2 as shown by equation (1).

In order that the balance of the laundry in the drum 10 may be detected, T2/T1 or a ratio of the rise time T1 to the fall time T2 is obtained by calculation (step B2). Since both of T1 and T2 are proportional to the weight of the laundry, both take respective predetermined values when the balance of the laundry is worsened. However, when the rise and fall times T1 and T2 are measured in an ill-balanced state of the laundry, the rise time T1 becomes longer, whereas the fall time T2 becomes shorter, as described above. As a result, the value of T2/T1 becomes smaller than a predetermined value. Accordingly, the balance of the laundry at the time of measurement can be detected when the value of T2/T1 is obtained by calculation. Furthermore, when the balance of the laundry is worsened exceeding a predetermined state, compensation is impossible even in the equation (1), whereupon the weight detection depending upon only equation (1) reduces an accuracy in the result of detection.

In view of the foregoing problem, the control circuit 36 determines whether T2/T1 is smaller than a predetermined value K, for example, 2.35, in the embodiment (step B3). When determining that T2/T1 is smaller than the predetermined value (or the balance of the laundry is worsened, the control circuit 36 compensates the value of S obtained at step B1 (step B4). In compensation, only an amount by which T2/T1 has dropped relative to the predetermined value K should be compensated using the following equation (2):

$$S'=S\times K/(T1/T2) \quad (2)$$

Thereafter, the control circuit 36 determines what range S' or S is in, thereby determining the weight of the laundry (steps B5 to B11). When S or S' is equal to or smaller than A (for example, 9.0), the control circuit 36 determines that a cloth amount (amount of laundry) is very small and ranges between 0 and 1 kg. When S or S' is larger than A and equal to or smaller than B (for example, 11.0), the control circuit 36 determines that the cloth amount is small and ranges between 1 and 2 kg. When S or S' is larger than B and equal to or smaller than C (for example, 13.0), the control circuit 36 determines that the cloth amount is intermediate and ranges between 2 and 4 kg. When S or S' is larger than C, the control circuit 36 determines that the cloth amount is large and equal to or exceeds 4 kg.

Upon completion of the weight detection routine, the control circuit 36 returns to the main routine (FIG. 1), displaying an amount of detergent at step A16. In this case, the control circuit 36 is provided with a data table containing data of results of detection in the weight detection routine and an amount of detergent corresponding to the results of detection in the weight detection routine. The control circuit 36 obtains an amount of detergent corresponding to the detection results on the basis of the data table. Data of the obtained amount of detergent is displayed on the display panel 27*a*. FIG. 4 shows a case where the obtained amount of detergent is "0.8" (cups). When viewing the display panel 27*a*, the user supplies a displayed amount of detergent into a detergent dispensing case (not shown). Thereafter, the washing operation is executed in accordance with the set washing course.

According to the above-described embodiment, the weight of the laundry in the drum 10 is determined on the basis of both pieces of information of rise and fall times T1 and T2. Consequently, the laundry weight detection can be executed at a lower cost in the embodiment than in the case where an amount of displacement of the water tub is detected. Further, the detecting accuracy can be rendered higher in the embodiment than in the case where the laundry weight is detected on the basis of either rise time or fall time. Moreover, the result of weight detection is compensated according to the result of detection of balance of the laundry. Accordingly, since an error due to the balance of the laundry is considered in the compensation, the detecting accuracy can further be improved. Additionally, a high accuracy is achieved even when the rise and fall times are detected on the basis of a low rotational speed of the motor or drum. Consequently, a detecting time can be reduced.

In the foregoing embodiment, an amount of detergent determined according to the detected laundry weight is displayed on the display panel 27*a*. The user can easily understand the amount of detergent to be used. Further, since the balance of the laundry is determined on the basis of the ratio (T2/T1) of the rise time T1 to the fall time T2, the balance of the laundry can easily be detected. Further, the second speed used in the detection of the rise time T1 is equal to or smaller than the resonance speed (about 250 rpm), namely, 230 rpm. Vibration or oscillation can be reduced in the detection of the rise time T1. In the foregoing embodiment, the third speed used in the detection of the fall time T2 is set at 290 rpm which is higher than the resonance speed of about 250 rpm. Further, for the detection of the fall time T2, the rotational speed of the drum 10 is increased a certain degree so that the laundry can be caused to stick to the drum. Consequently, measurement with a higher accuracy can be carried out. In this case, occurrence of the vibration or oscillation can be restricted when the rotational speed of the drum 10 is caused to pass the resonance speed at a stroke in order that the rotational speed of the drum may be increased up to 300 rpm for the detection of the fall time.

Figure 11:
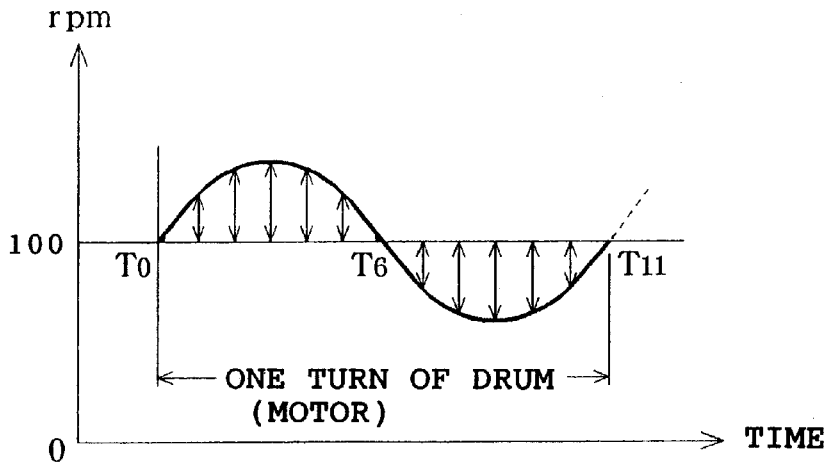
FIG. 11 is a view showing variation in the rotational speed of the motor or drum.

FIGS. 8 to 11 illustrate a second embodiment of the invention. In the second embodiment, a variation in the rotation of the motor 17 or drum 10 is detected (step A20) after the speed of the motor 17 is increased to 100 rpm. The aforesaid detection of variation is executed in the following manner. The speed of the motor 17 is increased to 100 rpm and thereafter, power supplied to the motor 17 is fixed at an average duty value during control at 100 rpm. Thereafter, a count (T0 to T11) corresponding to a rotational speed at each of twelve parts obtained by equally dividing one rotation of the drum 10 or motor 17 or by obtaining twelve equally divided angular speeds in one rotation of the drum 10 or motor 17. See FIG. 10. An average count value corresponding to an average rotational speed in one rotation is then obtained. An absolute value of the difference between the average count value and the count at each part, so that a degree of variation during one rotation can be detected. In the second embodiment, the rotation sensors 43*a* and 43*b*, and the control circuit 36 constitute rotational speed variation detecting means. FIG. 11 shows an example of pattern of variation degree of the rotational speed during one rotation of the drum 12 or motor 17.

Figure 9:
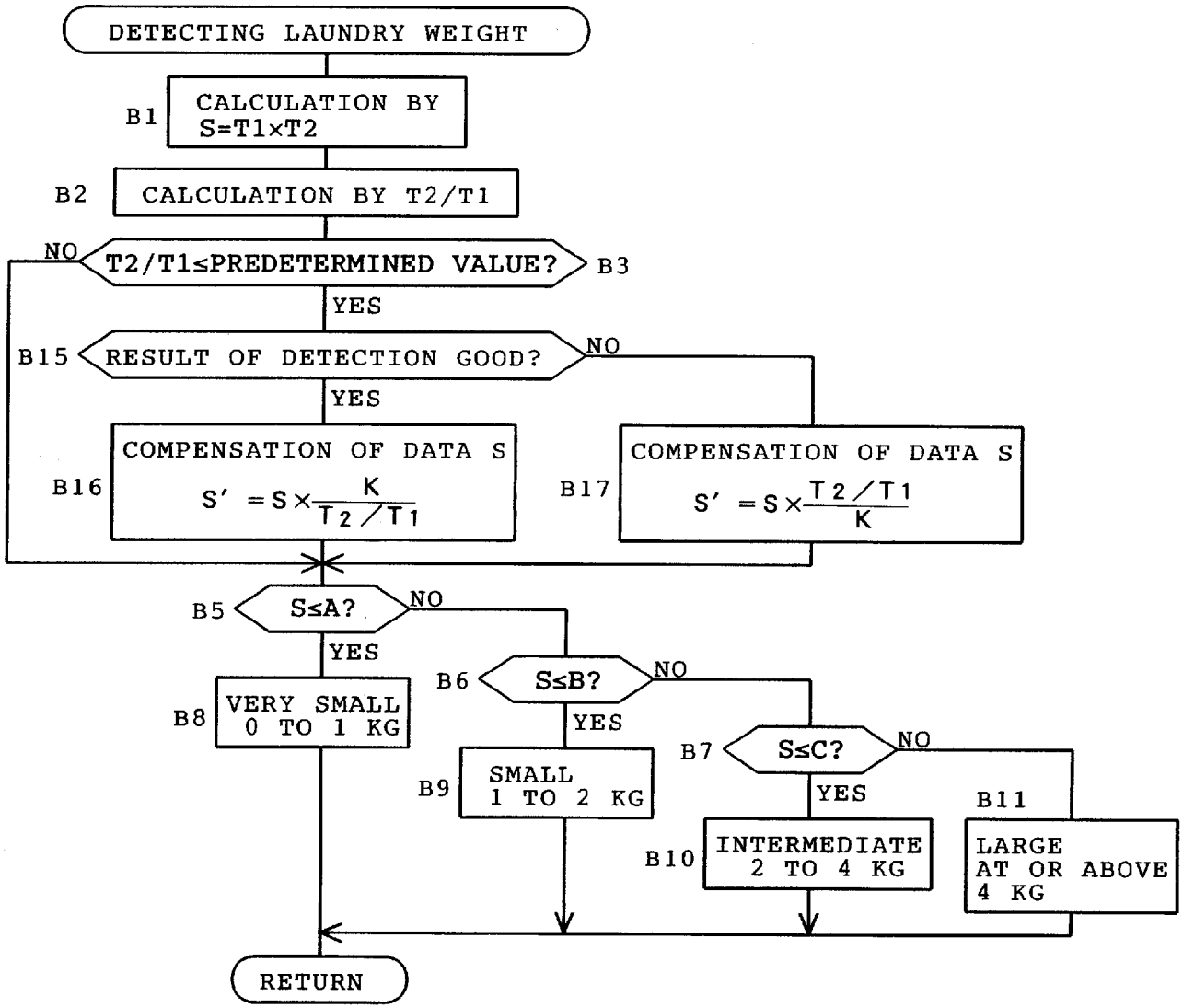
FIG. 9 is a view similar to FIG. 2 in the second embodiment.
Figure 10:
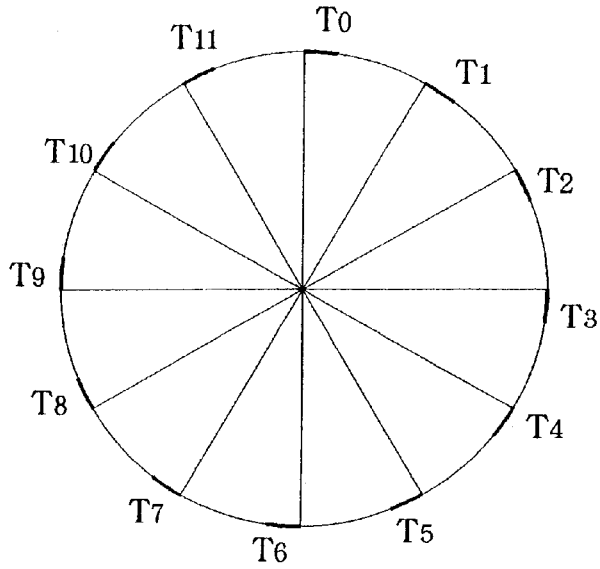
FIG. 10 is a view explaining detection of a varying state of the rotational speed.

Thereafter, the control circuit 36 determines whether the drum 10 has reached a reference position where the rotational speed becomes an average speed as T6 in FIG. 11 (step S21). When the drum 10 has reached the reference position, the power supplied to the motor 17 is changed from the fixed value to a duty value for acceleration so that the motor 17 is accelerated (step A3). Thereafter, the rise time T1 and fall time T2 are detected as in the first embodiment (steps A4 to A13). After the motor 17 has been turned off (step A14), the weight detection is carried out (step A22). FIG. 9 shows the weight detecting routine. Firstly, data S is obtained from the rise and fall times T1 and T2 as in the first embodiment (step B1). T2/T1 or the ratio of rise time T1 to the fall time T2 is calculated in order that the balance of the laundry in the drum 10 may be detected (step B2). Whether the value of T2/T1 is smaller than a predetermined value, for example, 2.35 (step B3). When the value of T2/T1 is smaller than the predetermined value, that is, when the laundry in the drum 10 is ill balanced, the control circuit 36 advances to step B15 to determine whether the result of detection of rotational speed variation at step A20 shows that the laundry is well balanced. When the result shows that the laundry is well balanced (step B15), the control circuit 36 advances to step B16 to compensate data S. In this case, the data S is compensated by the equation (2) as at step B4:

$$S'=S\times K/(T1/T2) \tag{2}$$

On the other hand, when the laundry in the drum 10 is ill balanced (step B15), the control circuit 36 advances to step B17 to compensate data S. The following equation (3) is used for the compensation:

$$S'=S\times(T2/T1)/K \tag{3}$$

The reason for execution of steps B15 to B17 will now be described in brief. When the rotational speed of the motor 17 is at 100 rpm, that is, before the rise time is detected, the laundry is sometimes well balanced or the degree of rotational speed variation is low. Thereafter, when the weight detection is carried out, the ratio of T2/T1 sometimes becomes small. The reason for this is that the rise of the rotational speed unbalances the laundry with the result that the fall time T2 becomes shorter. On the other hand, there is a case where the laundry is already ill balanced or the degree of rotational speed variation is high when the motor speed is at 100 rpm. In this case, the rise time T1 is rendered longer such that the ratio of T2/T1 becomes smaller. Accordingly, the rotational speed variation at 100 rpm of the motor speed necessitates compensation in the opposite direction.

Thereafter, the weight of the laundry is determined depending upon what range data S or data S' is in as in the first embodiment (steps B5 to B11).

According to the second embodiment, the rotational speed variation of the motor 17 is detected before detection of the rise time T1. The compensation is based on the result of rotational speed variation and the ratio of T2/T1 or the result of detection of laundry balance. Consequently, the accuracy in the weight detection can further be improved. Further, when the rise time T1 is detected, the motor 17 in rotation at the predetermined speed (T6 in FIG. 11) is accelerated. Consequently, since variations in the rise time T1 due to variations in the rotational state are prevented, the accuracy in the detection of the rise time T1 and accordingly in the detection of the weight of the laundry can further be improved.

Figure 12:
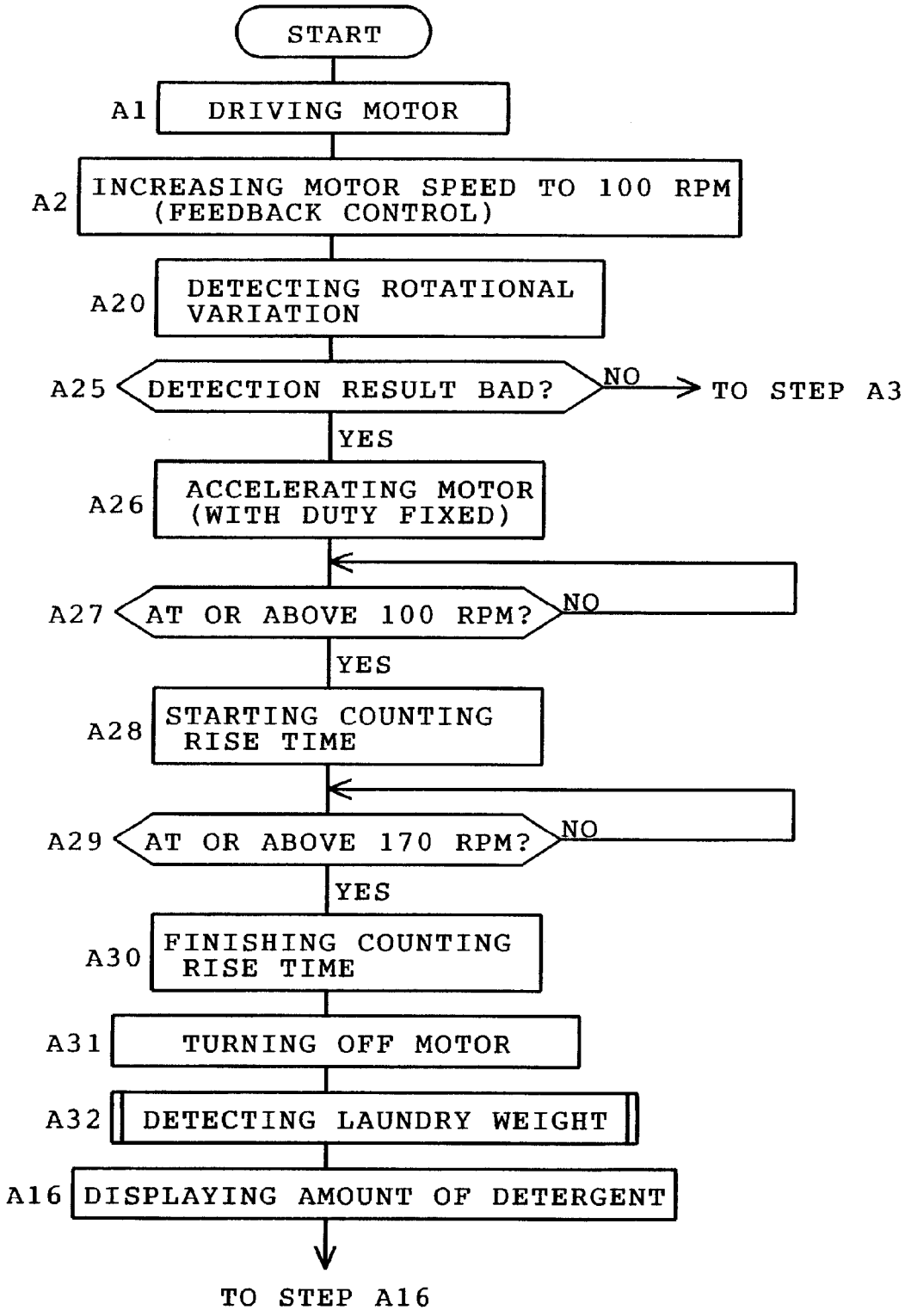
FIG. 12 is a flowchart showing an operating program from start to detection of laundry weight in a drum type washing machine of a third embodiment in accordance with the invention.
Figure 13:
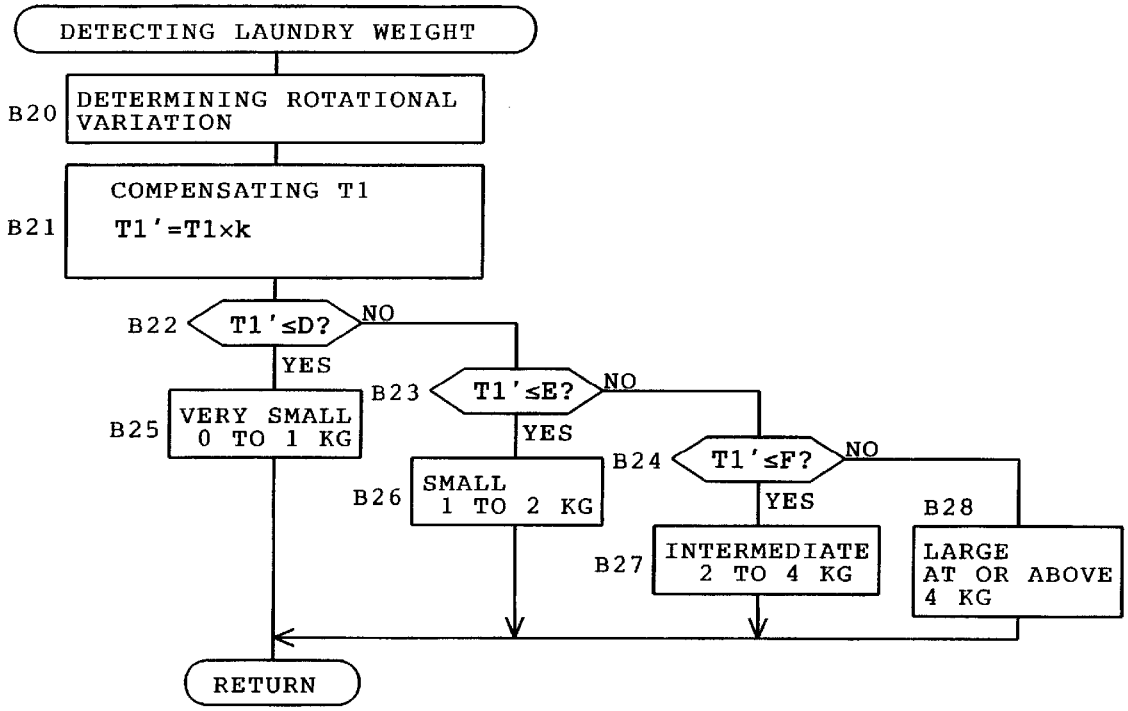
FIG. 13 is a view similar to FIG. 2.

FIGS. 12 to 14 illustrates a third embodiment of the invention. Referring to FIG. 12, the rotational speed of the motor 17 is increased to 100 rpm at step A2 and thereafter, the variations in the rotation of the motor 17 or drum 10 are detected (step A20). The detection of rotational speed variations is carried out in the same manner as in the second embodiment. In the third embodiment, the detection of rotational speed variations is carried out in order that whether the motor speed can be increased to, for example, 230 rpm may be determined in the detection of the rise time. In the detection of rotational speed variations, there is a possibility that the increase in the motor speed to 230 rpm may result in an abnormal vibration when the degree of variation is higher than a predetermined degree.

In view of the above-described problem, it is determined at step A25 whether the result of detection in the rotational speed variations is good. When determining that no problem results from the increase in the motor speed to 230 rpm (NO at step A25), the control circuit advances to step A3 in FIG. 1 or step A3 in FIG. 8, executing the above-described operation control. On the other hand, when determining that the increase in the motor speed to 230 rpm is inappropriate (YES at step A25), the control circuit advances to step A26 where the power supplied to the motor 17 (duty value) is fixed at a predetermined value and the motor is accelerated. The control circuit determines whether the rotational speed of the motor 17 has exceeded a first predetermined speed, for example, 110 rpm (step A27). When determining that the motor speed has exceeded the first predetermined speed, the control circuit starts counting the rise time (step A28).

The control circuit then determines whether the motor speed has exceeded a normal second predetermined speed which is lower than 230 rpm and does not cause abnormal vibration even when the laundry is ill balanced, for example, 170 rpm (step A29). When determining that the motor speed has exceed the second predetermined speed (YES at step A29), the control circuit finishes counting the rise time, storing data of the rise time T1 (step A30). Thereafter, the motor 17 is turned off (step A31) and the weight detection is carried out (step A32). FIG. 13 shows the weight detecting routine. Firstly, a rotational speed variation at 100 rpm or the laundry balance is determined at step B20 on the basis of the result of detection of the rotational speed variation at step A20. A compensation factor k corresponding to the determined rotational speed variation is obtained on the basis of the data table as shown in FIG. 14. The rise time T1 is multiplied by the obtained compensation factor k so as to be compensated (step B21). In this case, the rise time T1 becomes longer as the degree of rotational speed variation is high. Accordingly, the compensation factor k is rendered smaller when the variation degree is high. The value of the detected rotational speed variation is shown in hexadecimal numbers for convenience in processing by the microcomputer in FIG. 14. For example, "300H" in the hexadecimal notation corresponds to "768" in the decimal notation. As the value of rotational speed variation is large, the balance of the laundry becomes worse.

The compensated rise time T1' is compared with each of predetermined values D, E and F. The control circuit determines what range the compensated rise time T1' is in, thereby determining the weight of the laundry (steps B22 to B28). The predetermined values D, E and F are 1.9 sec., 2.1 sec., and 2.4 sec. respectively. The control circuit 36 has a function of auxiliary weight detecting means. After determining the weight of the laundry as described above, the control circuit 36 then returns to step A16 in the main routine (in FIG. 1 or FIG. 8) to display an amount of detergent according to the laundry weight.

According to the third embodiment, the degree of rotational speed variation is detected prior to the detection of the rise time. When it is determined that the rotational speed variation degree is high on the basis of the result of detection, namely, when the laundry in the drum 10 is ill balanced, the second predetermined speed for detection of the rise time T1 is set so as to be lower (170 rpm, for example). Consequently, occurrence of abnormal vibration can be prevented in the water tub 4 or the outer cabinet 1. Furthermore, when it is determined that the rotational speed variation degree is high on the basis of the result of detection, the weight of laundry is detected on the basis of only the rise time T1. Thus, the weight of laundry can be detected even when the laundry is ill balanced.

In the third embodiment, the motor 17 may be deenergized to assume a free running state after the rise time T1 has been detected (step A30). Further, the fall time T2 required for the motor speed to be reduced from 160 rpm to 100 rpm may be detected so that the weight of laundry is detected using both rise and fall times T1 and T2.

A rotational speed of the drum 10 may be detected instead of the rotational speed of the motor 17 in each of the foregoing embodiments.

The foregoing description and drawings are merely illustrative of the principles of the present invention and are not to be construed in a limiting sense. Various changes and modifications will become apparent to those of ordinary skill in the art. All such changes and modifications are seen to fall within the scope of the invention as defined by the appended claims.

We claim:

1. A drum type washing machine comprising:

a drum for accommodating laundry;

a variable speed electric motor for rotating the drum;

rotational speed detecting means for detecting a rotational speed of the drum or the motor;

rise time detecting means for detecting a rise time in a case where the drum or the motor is accelerated from a first predetermined rotational speed to a second predetermined rotational speed while a predetermined constant power is being supplied to the motor;

fall time detecting means for detecting a fall time in a case where the drum or the motor is decelerated from a third predetermined rotational speed to a fourth predetermined rotational speed while the motor is in a free running state;

weight detecting means for detecting a weight of the laundry in the drum on the basis of results of detection by the rise and fall time detecting means; and balance detecting means for detecting a balance of the laundry in the drum, wherein the weight detecting means compensates a result of detection according to a result of detection by the balance detecting means.

2. A drum type washing machine according to claim 1, further comprising control means for displaying an amount of a detergent to be used on the basis of the result of detection by the weight detecting means.

3. A drum type washing machine according to claim 1, wherein the balance detecting means determines the balance on the basis of a ratio of the rise time and the fall time.

4. A drum type washing machine according to claim 3, further comprising rotational speed variation detecting means for detecting a rotational speed variation of the drum or the motor before the rise time is detected, wherein the weight detecting means compensates the result of detection on the basis of a result of detection by the rotational speed variation detecting means and the result of detection by the balance detecting means.

5. A drum type washing machine according to claim 1, further comprising rotational speed variation detecting means for detecting a rotational speed variation of the drum or the motor before the rise time is detected, wherein the rise time detecting means varies the rotational speed for detection of the rise time according to a result of detection by the rotational speed variation detecting means.

6. A drum type washing machine according to claim 1, further comprising rotational speed variation detecting means for detecting a rotational speed variation of the drum or the motor before the rise time is detected, and auxiliary weight detecting means for detecting the weight of the laundry according to a result of detection by the rotational speed variation detecting means on the basis of the rise time detected by the rise time detecting means.

7. A drum type washing machine according to claim 1, further comprising rotational speed variation detecting means for detecting a rotational speed variation of the drum or the motor before the rise time is detected, wherein the rise time detecting means accelerates the drum from a constant speed on the basis of a result of detection by the rotational speed variation detecting means when detecting the rise time.

8. A drum type washing machine according to claim 1, wherein the rise time detecting means sets the second predetermined rotational speed to be equal to or higher than a resonant rotational speed.

9. A drum type washing machine according to claim 8, wherein the fall time detecting means sets the third predetermined rotational speed to be equal to or higher than the resonant rotational speed.

* * * * *